US008770720B2

(12) United States Patent
Tsuchihashi et al.

(10) Patent No.: US 8,770,720 B2
(45) Date of Patent: Jul. 8, 2014

(54) LIQUID EJECTING APPARATUS

(71) Applicant: Seiko Epson Corporation, Tokyo (JP)

(72) Inventors: Ryosuke Tsuchihashi, Matsumoto (JP); Kinya Ozawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/851,388

(22) Filed: Mar. 27, 2013

(65) Prior Publication Data

US 2013/0286101 A1 Oct. 31, 2013

(30) Foreign Application Priority Data

Apr. 27, 2012 (JP) ..... 2012-104154

(51) Int. Cl.
*B41J 2/14* (2006.01)
*G01D 11/00* (2006.01)

(52) U.S. Cl.
USPC ..... 347/54; 347/100

(58) Field of Classification Search
USPC ..... 347/54, 68, 70, 71, 72
See application file for complete search history.

(56) References Cited

U.S. PATENT DOCUMENTS

2007/0194449 A1* 8/2007 Hirai ..... 257/750
2008/0026499 A1 1/2008 Moriya et al.
2008/0182085 A1 7/2008 Oyanagi et al.
2010/0080925 A1* 4/2010 Araki et al. ..... 427/511
2011/0234681 A1 9/2011 Nakane

FOREIGN PATENT DOCUMENTS

JP 2008-208330 9/2008
JP 2011-195747 10/2011

* cited by examiner

*Primary Examiner* — Lisa M Solomon
(74) *Attorney, Agent, or Firm* — Harness, Dickey & Pierce, P.L.C.

(57) ABSTRACT

A liquid ejecting apparatus has a head component that ejects a liquid through nozzle openings to attach the liquid to an object. The liquid contains a particulate material having a particle size of 200 nm to 1 μm, both inclusive, and the head component discharges the liquid in droplets weighing 1 ng to 7 ng, both inclusive, in a way that the droplets reach the object at a velocity of 5 m/s to 9 m/s, both inclusive.

2 Claims, 4 Drawing Sheets

LIQUID EJECTING APPARATUS

The entire disclosure of Japanese Patent Application No. 2012-104154, filed Apr. 27, 2012 is expressly incorporated by reference herein.

BACKGROUND

1. Technical Field

The present invention relates to a liquid ejecting apparatus.

2. Related Art

A representative example of a liquid ejecting apparatus is an ink jet recording apparatus. Ink jet recording apparatuses include serial-head ones and line-head ones. The former produces prints by moving ink jet recording heads mounted on a carriage, while the latter does so by ejecting ink through nozzles arranged over the same width as the entire width of the recording medium used. A typical ink jet recording head incorporates actuators, each of which is composed of a pressure chamber and a piezoelectric element. The pressure chamber communicates with a nozzle opening for discharging ink droplets and has a diaphragm. The piezoelectric element vibrates in a flexural mode to deform the diaphragm and compress the ink in the pressure chamber, whereby ink droplets are discharged through the nozzle opening.

White inks containing particulate titanium oxide, which is a white pigment, have been used with ink jet recording heads of this type (e.g., see JP-A-2008-208330).

Pigment particles used in white inks of that kind are often as large as 200 nm or more in average diameter because such large particles can effectively mask the resulting prints, thereby giving the prints the desired characteristics.

However, white inks containing such large particles are likely to produce a mist. As mentioned above, white inks are highly opaque. A liquid ejecting apparatus has an encoder for positioning its carriage, and once a mist generated from a white ink adheres to the scan window of this encoder, the encoder cannot locate the exact position of the carriage and thus cannot position the carriage.

SUMMARY

An advantage of an aspect of the invention is that it provides a liquid ejecting apparatus the liquid discharged from which is unlikely to produce a mist even when it is an ink containing large particles having an average diameter of 200 nm or more.

The liquid ejecting apparatus according to an aspect of the invention is one having a head component that ejects a liquid through nozzle openings to attach the liquid to an object. The liquid contains a particulate material having a particle size of 200 nm to 1 μm, both inclusive, and the head component discharges the liquid in droplets weighing 1 ng to 7 ng, both inclusive, in a way that the droplets reach the object at a velocity of 5 m/s to 9 m/s, both inclusive. The liquid discharged from the liquid ejecting apparatus according to this aspect of the invention, which discharges the liquid in droplets weighing 1 ng to 7 ng, both inclusive, from the head component thereof in a way that the droplets reach the object at a velocity of 5 m/s to 9 m/s, both inclusive, is unlikely to produce a mist even when it is an ink containing large particles having an average diameter of 200 nm or more.

In a preferred embodiment of the invention, the particulate material is particulate titanium oxide.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment

Figure 1:
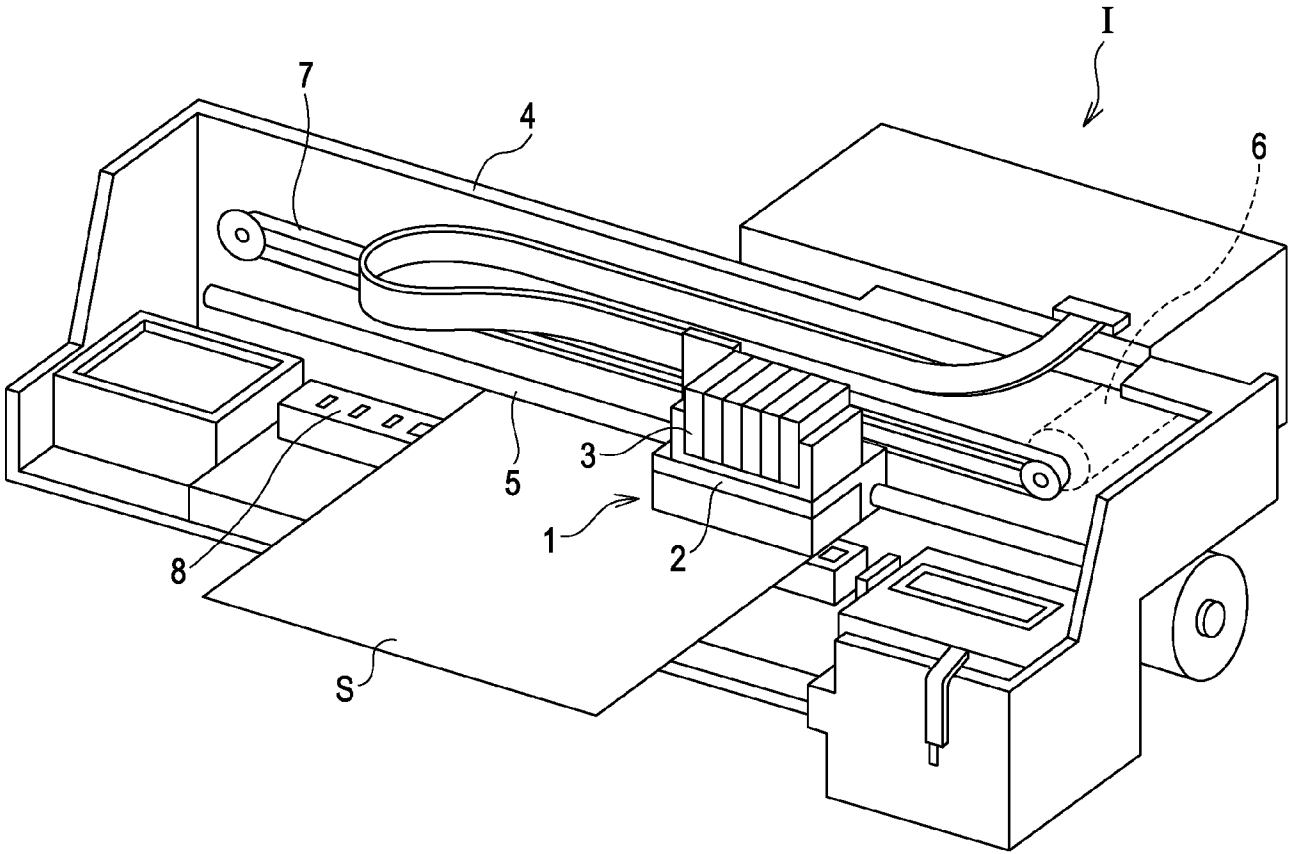
FIG. 1 schematically illustrates a recording apparatus according to an embodiment of the invention.

FIG. 1 schematically illustrates a perspective view of an ink jet recording apparatus as a typical liquid ejecting apparatus according to an embodiment of the invention. As illustrated in FIG. 1, the ink jet recording apparatus I according to an aspect of the invention has an ink jet recording head (hereinafter also referred to as a recording head) 1, which is an example of a liquid ejecting head that discharges ink droplets, and a carriage 2 supporting it. An encoder (not illustrated) is on the back of this carriage 2.

This recording head 1 has detachable ink cartridges 3 as typical liquid reservoirs for storing inks. In this embodiment, the ink cartridges 3 contain inks of different colors and include one containing a white ink (detailed later herein).

The carriage 2 supporting the recording head 1 is free to move along a carriage shaft 5 installed in the main body 4. Once the motor 6 is activated, the generated driving force is transmitted through gears (not illustrated) and a timing belt 7 to the carriage 2, moving the carriage 2 along the carriage shaft 5. The encoder tracks the carriage 2 during this movement. As a result, the carriage 2 can be precisely moved.

The main body 4 also has a platen 8 extending along the carriage shaft 5; a feeding unit or any other kind of feeder (not illustrated) feeds a recording medium S such as paper, which is then transported by the platen 8.

Figure 2:
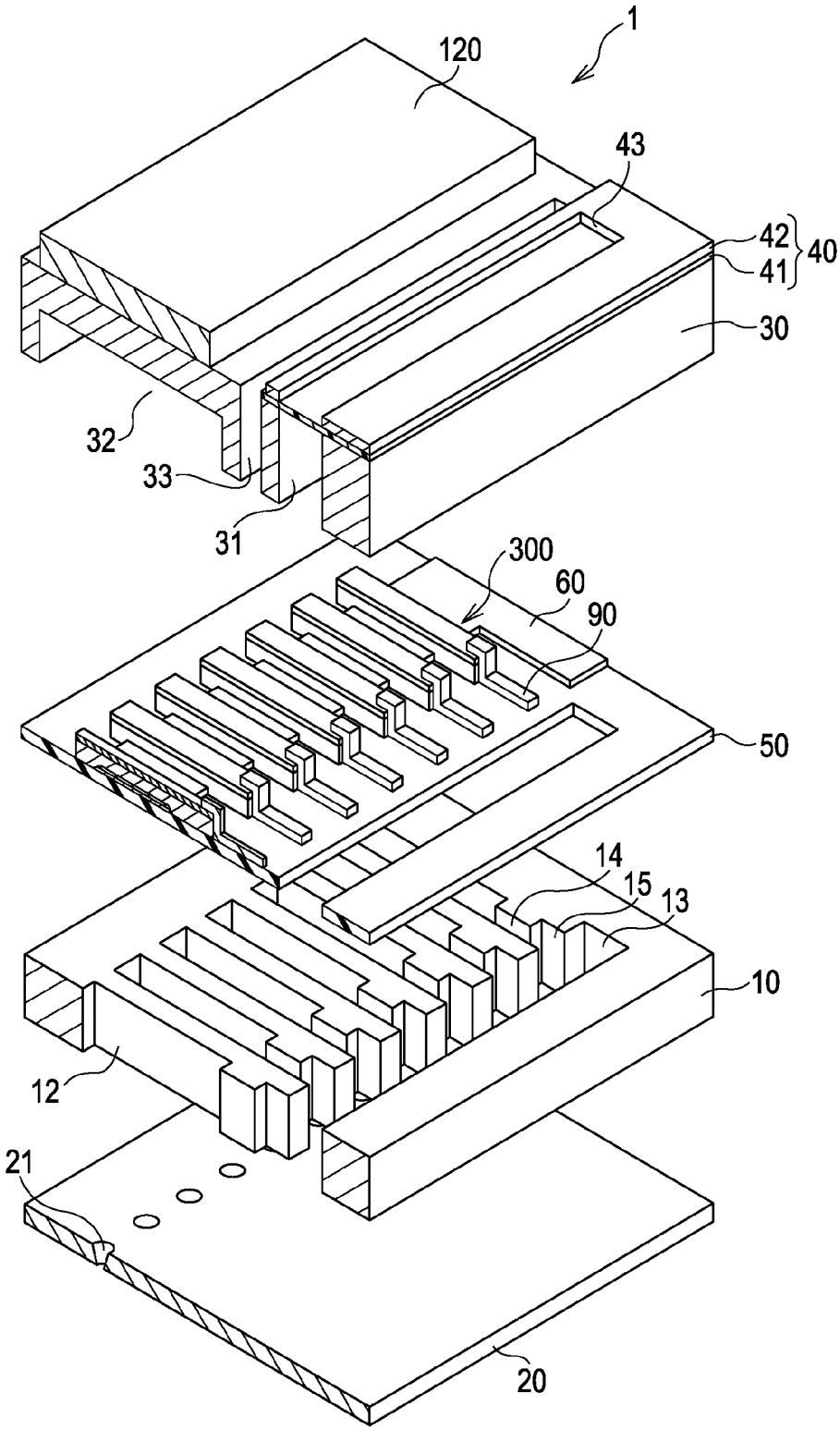
FIG. 2 is an exploded perspective diagram illustrating the recording head used in an embodiment of the invention.
Figure 3:
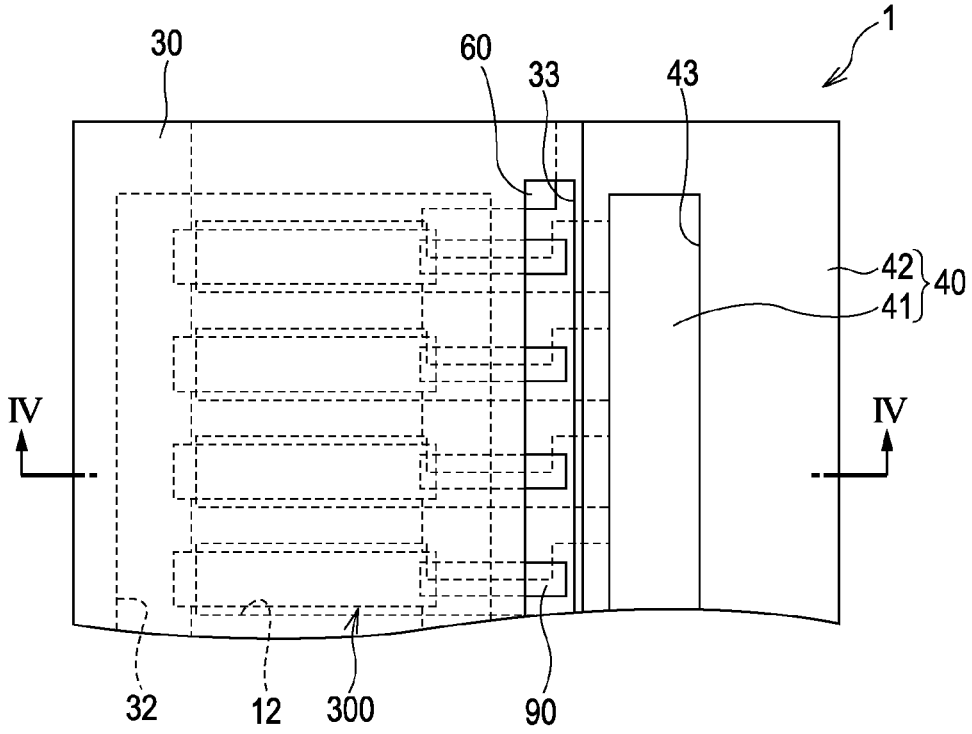
FIG. 3 is a plan view of the recording head used in an embodiment of the invention.
Figure 4:
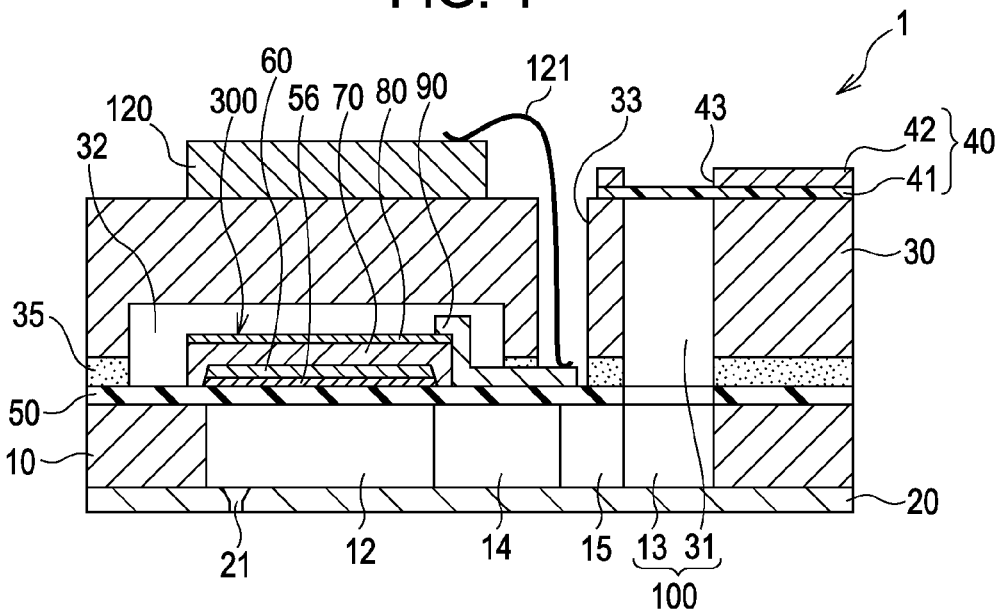
FIG. 4 is a cross-sectional view of the recording head used in an embodiment of the invention.

FIG. 2 is an exploded perspective diagram schematically illustrating the constitution of an ink jet recording head as a typical liquid ejecting head used in this embodiment of the invention. FIG. 3 is a plan view of FIG. 2, and FIG. 4 is a cross-sectional view taken along line IV-IV of FIG. 3. As illustrated in FIGS. 2 to 4, the flow channel substrate 10 used in this embodiment, which is a silicon single crystal substrate, is covered on either side with an elastic film 50, which is made of silicon dioxide.

The flow channel substrate 10 has several pressure chambers 12 arranged in parallel. The flow channel substrate 10 also has a communicating space 13 in the region outside with respect to the longitudinal direction of the pressure chambers 12, and the communicating space 13 communicates with the pressure chambers 12 via ink supply paths 14 and communicating paths 15 formed for the respective pressure chambers 12. The communicating space 13 also communicates with a manifold portion 31 of a protective substrate (described later herein) to form a manifold, a common ink tank for the pressure chambers 12. The ink supply paths 14 are narrower in width than the pressure chambers 12 so as to maintain a constant resistance to the flow of ink from the communicating space 13 into the pressure chambers 12. Although in this embodiment the ink supply paths 14 are formed by narrowing each branch of the flow channel from one lateral side, it is also possible to form ink supply paths by narrowing each branch of the flow channel from both lateral sides. It is also allowed to form ink supply paths by reducing the height of each branch of the flow channel instead of the width. The flow channel substrate 10 in this embodiment therefore has a liquid flow channel formed by the pressure chambers 12, the communicating space 13, the ink supply paths 14, and the communicating paths 15.

To the opening side of the flow channel substrate 10 a nozzle plate 20, which is drilled in advance to have nozzle openings 21 leading to the extremity of the pressure chambers 12 opposite to the ink supply paths 14, is bonded with an adhesive agent, hot-melt film, or some other adhesive material. Examples of materials used to make the nozzle plate 20 include glass ceramics, a silicon single crystal substrate, and stainless steel.

As described above, there is an elastic film 50 on the side of the flow channel substrate 10 opposite to the opening side. This elastic film 50 is coated with an adhesive layer 56, which is a titanium oxide film having a thickness on the order of 30 to 50 nm, for example, and works to improve the adhesion between a first electrode 60 and its base including the elastic film 50. The elastic film 50 may be coated with an insulating film made of zirconium oxide or a similar material where necessary.

On this adhesive layer 56, furthermore, a first electrode 60, a piezoelectric layer 70 (a thin film having a thickness of 2 μm or less or preferably a thickness of 0.3 to 1.5 μm), and a second electrode 80 are stacked to form piezoelectric elements 300. Each piezoelectric element 300 is a unit including the first electrode 60, the piezoelectric layer 70, and the second electrode 80. Usually, either of the two electrodes of the piezoelectric elements 300 is used as a common electrode, and the other electrode and the piezoelectric layer 70 are patterned to fit the pressure chambers 12. Although in this embodiment the first electrode 60 serves as a common electrode for the piezoelectric elements 300 and the second electrode 80 as separate electrodes for the piezoelectric elements 300, this assignment may be reversed due to any driver arrangement or wiring problems. Each piezoelectric element 300 and a portion displaced by the operation of the piezoelectric element 300 (a diaphragm) are collectively referred to as an actuator herein. Although in the above constitution the elastic film 50, the adhesive layer 56, and the first electrode 60 (and the insulating film if it is formed) form diaphragms, this is not the only possible constitution, of course. For example, the elastic film 50 and the adhesive layer 56 are not always necessary. It is also possible that the piezoelectric elements 300 themselves practically double as diaphragms.

To the individual sections of the second electrode 80, which serve as separate electrodes for the piezoelectric elements 300, lead electrodes 90 made of gold (Au) or a similar material are connected, extending from the extremity of the electrode sections opposite to the ink supply paths 14 to the elastic film 50 (or the insulating film if it is formed).

The upper surface of the flow channel substrate 10 having the piezoelectric elements 300 formed in such a way as described above, or in other words the first electrode 60, the elastic film 50 (or the insulating film if it is formed), and the lead electrodes 90, is covered with a protective substrate 30, which has a manifold portion 31 serving as at least a component of a manifold 100 and is bonded using an adhesive agent 35. In this embodiment, the manifold portion 31 is formed through the entire thickness of the protective substrate 30 and along the direction of the width of the pressure chambers 12 and, as mentioned above, communicates with the communicating space 13 of the flow channel substrate 10 to form the manifold 100, a common ink tank for the pressure chambers 12. It is also possible to divide the communicating space 13 of the flow channel substrate 10 into several portions corresponding to the pressure chambers 12 so that the manifold portion 31 can solely serve as a manifold. Other constitutions may also be allowed, including one in which only the pressure chambers 12 are formed in the flow channel substrate 10, and the ink supply paths 14 are formed in the portion between the flow channel substrate 10 and the protective substrate 30 (e.g., the elastic film 50, and the insulating film if it is formed) to ensure the communication between the manifold 100 and the pressure chambers 12.

The protective substrate 30 further has a piezoelectric element housing 32 facing the piezoelectric elements 300 and having a space large enough to allow the piezoelectric elements 300 to move. It does not matter whether the space the piezoelectric element housing 32 has is tightly sealed or not as long as the space is large enough to allow the piezoelectric elements 300 to move.

Preferably, the protective substrate 30, prepared and used in such a way as described above, is made of a material having a coefficient of thermal expansion equal to or similar to that of the flow channel substrate 10, such as glass or a ceramic material. In this embodiment, it is made of the same material as the flow channel substrate 10, i.e., a silicon single crystal substrate.

The protective substrate 30 additionally has a through-hole 33 formed through the entire thickness of the protective substrate 30. Either extremity of the individual lead electrodes 90 extending from the piezoelectric elements 300 is exposed in this through-hole 33.

Furthermore, a driver 120 for activating the parallel arranged piezoelectric elements 300 is mounted on the protective substrate 30. Examples of components used as this driver 120 include a printed circuit board and a semiconductor integrated circuit (IC). The driver 120 and the lead electrodes 90 are connected via wiring 121 based on conductive wires such as bonding wires.

Besides these, a compliance substrate 40 having a sealing film 41 and a stationary plate 42 is bonded to the protective substrate 30. The sealing film 41 is made of a low-rigidity flexible material, and the manifold portion 31 is sealed with this sealing film 41 on either side. The stationary plate 42 is made of a relatively hard material. This stationary plate 42 has an opening 43 formed through its entire thickness over the area facing the manifold 100; one face of the manifold 100 is sealed with the flexible sealing film 41 only.

Incorporating the ink jet recording head 1 constituted in such a way as described above, the recording apparatus I of this embodiment receives inks from the ink cartridges 3 via ink inlets, fills the entire space from the manifold 100 to the nozzle openings 21 with the inks, and then, in response to recording signals transmitted from the driver 120, distributes voltage to the first electrode 60 and the second electrode 80 so that the elastic film 50, the adhesive layer 56, the first electrode 60, and the piezoelectric layer 70 should undergo flexural deformation at the positions corresponding to appropriate pressure chambers 12. As a result, the selected pressure chambers 12 are pressurized and eject ink droplets through the corresponding nozzle openings 21. The ejected ink droplets then land on the recording medium S.

The white ink used in this embodiment is one containing a particulate material having a 50%-volume sphere-equivalent particle diameter (d50) of 200 nm to 1 μm, as measured by light scattering. A particulate material with a d50 smaller than 200 nm makes the ink insufficiently opaque, and a particulate material with a d50 exceeding 1 μm makes the ink difficult to discharge. In relation to the weight of the ink, the d50 of this particulate material is preferably in the range of 200 nm to 500 nm.

The following is a procedure to determine the 50%-volume sphere-equivalent particle diameter (d50) of a particulate material by light scattering. First, the particles are put into a dispersion medium and irradiated with light, and the diffracted and scattered light is measured using detectors located in the front and the rear of and laterally to the dispersion medium. A cumulative curve is then constructed from the measurements on the assumption that the amorphous particles are spheres having the same volume, with the total volume of this imaginary spherical particle population as 100%. The point at which the cumulative volume is 50% is the 50%-volume sphere-equivalent particle diameter (d50). An example of an analyzer that can be used to determine this parameter is LMS-2000e laser diffraction/scattering particle size distribution analyzer (Seishin Enterprise Co., Ltd.). Particles having a 50%-volume sphere-equivalent particle diameter (d50) falling within the range specified above as measured by light scattering make the ink able to form highly opaque coatings on records and ensure that the ink can be ejected through nozzles with high discharge stability.

Examples of materials that can be used to form this particulate material include oxides of group-IV elements such as titanium dioxide and zirconium dioxide. Other options include calcium carbonate, calcium sulfate, zinc oxide, barium sulfate, barium carbonate, silica, alumina, kaolinite, clay, talc, white earth, aluminum hydroxide, magnesium carbonate, and emulsions containing white hollow resin particles. Preferably, the particulate material is one or a mixture of two or more selected from the group consisting of these and other similar materials. In this embodiment, the particulate material is particulate titanium dioxide.

It is preferred, in terms of the degree of whiteness of the white ink, that the amount of the particulate material in the white ink is 1.0% by weight or more. The amount of the particulate material in the white ink is more preferably 5.0% by weight or more, and even more preferably in the range of 10% by weight to 20% by weight, both inclusive.

The ink containing this particulate material further contains such ingredients as an organic solvent and a resin in addition to the particulate material.

The organic solvent is preferably a polar organic solvent. Examples include alcohols (e.g., methyl alcohol, ethyl alcohol, propyl alcohol, butyl alcohol, isopropyl alcohol, and fluoroalcohols), ketones (e.g., acetone, methyl ethyl ketone, and cyclohexanone), carboxylates (e.g., methyl acetate, ethyl acetate, propyl acetate, butyl acetate, methyl propionate, 4-butyrolactone, and ethyl propionate), and ethers (e.g., diethyl ether, dipropyl ether, diethylene glycol diethyl ether, diethylene glycol methyl ether, tetrahydrofuran, and dioxane).

As for the resin, examples include acrylic resins, styrene-acrylic resins, rosin-modified resins, terpene resins, polyester resins, polyamide resins, epoxy resins, polyvinyl chloride resins, vinyl chloride-vinyl acetate copolymers, cellulose resins (e.g., cellulose acetate butyrate and hydroxypropylcellulose), polyvinyl butyral, polyacrylic polyol, polyvinyl alcohol, and polyurethane.

Preferably, the ink further contains a dispersant for dispersing the particulate material. Examples of suitable dispersants include ones commonly used in inks, such as cationic, anionic, and nonionic dispersants as well as surfactants.

Examples of anionic dispersants that can be used include polyacrylic acid, polymethacrylic acid, acrylic acid-acrylonitrile copolymers, vinyl acetate-acrylate copolymers, acrylic acid-alkyl acrylate copolymers, styrene-acrylic acid copolymers, styrene-methacrylic acid copolymers, styrene-acrylic acid-alkyl acrylate copolymers, styrene-methacrylic acid-alkyl acrylate copolymers, styrene-α-methylstyrene-acrylic acid copolymers, styrene-α-methylstyrene-acrylic acid-alkyl acrylate copolymers, styrene-maleic acid copolymers, vinyl naphthalene-maleic acid copolymers, vinyl acetate-ethylene copolymers, vinyl acetate-fatty acid vinyl ethylene copolymers, vinyl acetate-maleate copolymers, vinyl acetate-crotonic acid copolymers, and vinyl acetate-acrylic acid copolymers.

Examples of nonionic dispersants that can be used include polyvinylpyrrolidone, polypropylene glycol, and vinyl pyrrolidone-vinyl acetate copolymers.

Examples of surfactants that can be used as dispersants in this embodiment include anionic surfactants such as sodium dodecylbenzene sulfonate, sodium laurate, and ammonium salts of polyoxyethylene alkyl ether sulfates as well as nonionic surfactants such as polyoxyethylene alkyl ethers, polyoxyethylene alkyl esters, polyoxyethylene sorbitan fatty acid esters, polyoxyethylene alkyl phenyl ethers, polyoxyethylene alkyl amines, and polyoxyethylene alkyl amides. Styrene-(meth)acrylic copolymers are particularly preferred as they can effectively improve the dispersion stability of the particulate material.

Such organic solvents, resins, and dispersants as listed above can also be used in a combination of two or more thereof.

The white ink used in this embodiment may further contain additives commonly used in ordinary ink compositions. Examples of appropriate additives include stabilizing agents (e.g., antioxidants and ultraviolet absorbents).

The white ink can be prepared by known and commonly used processes. The following is a typical process. First, the particulate material described above and a dispersant are mixed. A liquid dispersion containing these ingredients is then prepared using a ball mill, a bead mill, a sonicator, or a jet mill or by some other means. After the resulting dispersion is treated for the desired ink characteristics, the dispersion is stirred and a binder resin, an organic solvent, and other additives (e.g., a dispersion aid and a viscosity modifier) are added to complete the white ink.

This white ink is discharged through the nozzle openings 21 of the ink jet recording head 1 of the recording apparatus I. In this process, ink droplets weighing 1 to 7 ng are discharged to have a main velocity of 5 to 9 m/s.

The term main velocity, as used herein, refers to the estimated velocity of the ink droplets at their landing points. The ink droplet in this context represents the main component, or the head, of a drop of ink discharged as a result of application of a drive voltage and does not include the tail of the drop or any drops separated from the original one. Discharging ink droplets weighing 1 to 7 ng in a way that makes their main velocity fall within the range of 5 to 9 m/s reduces the amount of mist produced and thus prevents reduced positional precision of landing droplets that could occur due to increased viscosity of the ink. Discharging ink droplets in a way that makes their main velocity less than 5 m/s often results in the ink droplets being displaced from their intended landing points and, furthermore, being separated into smaller drops, which are airborne and thus likely to turn into a mist. Discharging ink droplets in a way that makes their main velocity exceed 9 m/s also often results in the ink droplets turning into a mist. It is therefore preferred to discharge ink droplets in a way that makes their main velocity fall within the range of 5 to 9 m/s as stated above.

As for the weight of ink droplets, droplets weighing more than 7 ng are too large to be discharged as desired, and droplets weighing less than 1 ng are too small and have reduced discharge characteristics.

The recording apparatus I discharges 1- to 7-ng ink droplets through its ink jet recording head 1 in a way that makes their main velocity fall within the range of 5 to 9 m/s, thereby allowing for ink discharge with reduced mist generation. The recording apparatus I is programmed with discharge characteristics data of such particle-containing inks in advance and can change the discharge conditions of its recording head 1 depending on the type of ink.

The weight and discharge velocity of ink droplets can be changed by modifying, among others, the difference between the maximum and minimum drive voltages and the rate of drive voltage change. Some specific examples of drive voltage will be described later herein.

EXAMPLES AND COMPARATIVE EXAMPLES

In these examples and comparative examples, a white ink containing a particulate material was subjected to discharge processes and its discharge characteristics were evaluated. The ink was first discharged in 6-ng droplets with different main velocities, followed by the assessment of discharge characteristics, and then in 4-ng or smaller droplets with different main velocities, also followed by the assessment of discharge characteristics. The distance between the nozzle plane of the recording head and the platen was 1.5 mm. The ink contained diethylene glycol diethyl ether, diethylene glycol methyl ether, 4-butyrolactone, and Equamide M100 (trade name, Idemitsu Kosan Co., Ltd.) (organic solvents), an acrylic copolymer and a vinyl chloride-vinyl acetate copolymer (dispersants), and 15% by weight of particulate titanium dioxide with a median diameter (d50) of 300 nm.

Figure 5A:
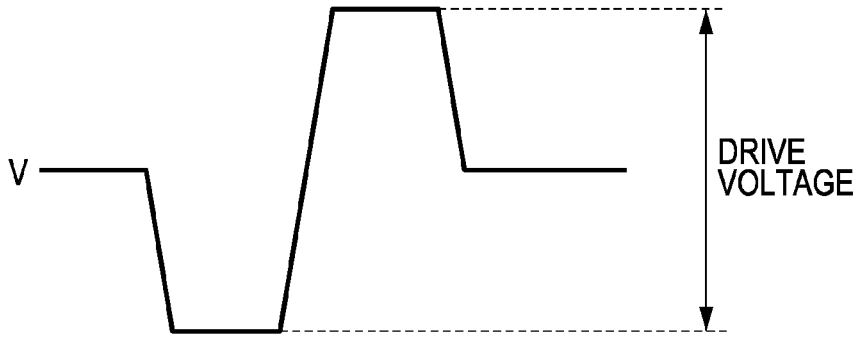
FIGS. 5A and 5B schematically illustrate drive signals.
Figure 5B:
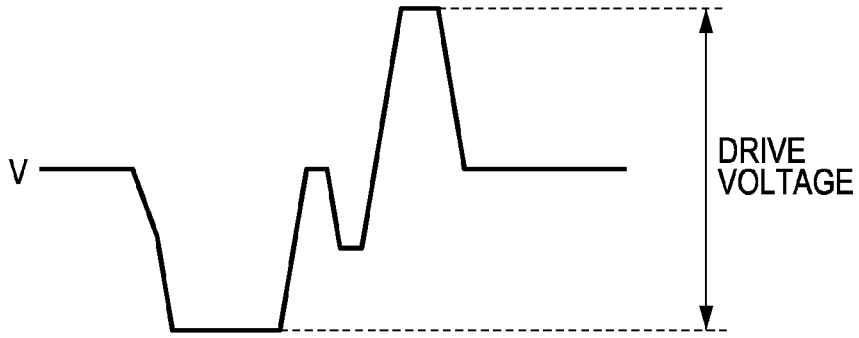

The main velocity of ink droplets was changed by modifying the rate of drive voltage change and the magnitude of drive voltage in the drive signal in these examples and comparative examples. Two different drive signals were used: the drive signal illustrated in FIG. 5A was used with 6-ng ink droplets, and the drive signal illustrated in FIG. 5B was used with 4-ng or smaller ink droplets. The voltage changes in the respective drive signals were as illustrated in the drawings. Although different drive signals were used depending on the size of ink droplets in this way, these drive signals were similar in that it was possible to change the main velocity of the ink droplets as required by modifying the rate of drive voltage change and the magnitude of drive voltage in the drive signal. Other forms of drive signals can also be used as long as they ensure the desired discharge conditions for specific purposes.

The discharge characteristics evaluated were mist generation and an attribute that can be referred to as intermittent landing precision. The intermittent landing precision was determined on the basis of the displacement of landing droplets from their intended landing points after an intermission (7 seconds in these examples and comparative examples). As for mist generation, a particle counter was used to determine the presence or absence of a mist.

Table 1 shows the results for 6-ng ink droplets, and Table 2 shows the results for 4-ng or smaller ink droplets. Tables 1 and 2 use the following conventions: ⊙, excellent (no mist generated); ○, good (only a slight amount of mist generated); Δ, acceptable (a small amount of mist generated); ×, unacceptable (a considerable amount of mist generated).

TABLE 1

| | Velocity (m/s) | | | | | | |
|---|---|---|---|---|---|---|---|
| | 4 | 5 | 6 | 7 | 8 | 9 | 10 |
| Mist | ⊙ | ⊙ | ○ | ○ | ○ | Δ | X |
| Intermittent | X | Δ | ○ | ○ | ○ | ○ | ○ |

TABLE 2

| | Velocity (m/s) | | | | | | |
|---|---|---|---|---|---|---|---|
| | 4 | 5 | 6 | 7 | 8 | 9 | 10 |
| Mist | X | ○ | ○ | ○ | ○ | Δ | X |
| Intermittent | X | Δ | ○ | ○ | ○ | ○ | ○ |

As can be seen from Table 1, no mist was produced with a main velocity of 4 m/s or 5 m/s, only a slight amount of mist with 6 to 8 m/s, a small amount of mist with 9 m/s, and a considerable amount of mist with 10 m/s when 6-ng ink droplets were used, and the intermittent landing precision was unacceptable with a main velocity of 4 m/s, acceptable with 5 m/s, and good with 6 to 10 m/s when 6-ng ink droplets were used.

Furthermore, as can be seen from Table 2, a considerable amount of mist was produced with a main velocity of 4 m/s, only a slight amount of mist with 5 to 8 m/s, a small amount of mist with 9 m/s, and a considerable amount of mist with 10 m/s when 4-ng or smaller ink droplets were used, and the intermittent landing precision was unacceptable with a main velocity of 4 m/s, acceptable with 5 m/s, and good with 6 to 10 m/s when 4-ng or smaller ink droplets were used.

These results indicate that when an ink containing particles is discharged in 4-ng or smaller droplets or 6-ng droplets, the generation of a mist can be effectively prevented and high intermittent landing precision is ensured by making the main velocity of the ink droplets fall within the range of 5 to 9 m/s.

Note that the scope of the invention is not limited to the above embodiment.

While the above embodiment illustrates the ink jet recording apparatus I as a liquid ejecting apparatus according to an aspect of the invention, the basic configuration of liquid ejecting apparatuses covered by the invention is not limited to it. The invention may cover many other kinds of liquid ejecting apparatuses, including ones used with the following head components: recording heads for printers and other kinds of image recording apparatus; colorant ejecting heads for the production of color filters for liquid crystal displays and other kinds of displays; electrode material ejecting heads for the formation of electrodes for organic EL displays, field emission displays (FEDs), and other kinds of displays; and bioorganic substance ejecting heads for the production of biochips.

Although the ink jet recording apparatus described above as an embodiment of the invention is a serial-head one, which produces prints by moving ink jet recording heads mounted on a carriage, the invention can also be applied to line-head ones, which produce prints by ejecting ink through nozzles arranged over the same width as the entire width of the recording medium used. Furthermore, although in the above embodiment the ink cartridges as liquid reservoirs are mounted on the carriage together with the liquid ejecting head, this is not the only possible arrangement; for example, it is possible to separate the liquid reservoirs from the carriage in the recording apparatus I.

What is claimed is:

1. A liquid ejecting apparatus comprising a head component that ejects a liquid through nozzle openings to attach the liquid to an object, wherein:

the liquid contains a particulate material having a particle size of 200 nm to 1 μm, both inclusive;

the head component discharges the liquid in droplets weighing 1 ng to 7 ng, both inclusive, in a way that the droplets reach the object at a velocity of 5 m/s to 9 m/s, both inclusive; and the particle size of the particulate material is a 50%-volume sphere equivalent particle diameter, as measured by light scattering.

2. The liquid ejecting apparatus according to claim 1, wherein:

the particulate material is particulate titanium oxide.

* * * * *